US007668477B2

(12) United States Patent
Honobe et al.

(10) Patent No.: US 7,668,477 B2
(45) Date of Patent: Feb. 23, 2010

(54) CLEANING DEVICE, PROCESS CARTRIDGE, AND IMAGE FORMING DEVICE

(75) Inventors: Satoshi Honobe, Kanagawa (JP); Yasutaka Matsumoto, Kanagawa (JP); Ryouta Kubo, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 504 days.

(21) Appl. No.: 11/730,475

(22) Filed: Apr. 2, 2007

(65) Prior Publication Data

US 2008/0056757 A1 Mar. 6, 2008

(30) Foreign Application Priority Data

Aug. 29, 2006 (JP) ..... 2006-232517

(51) Int. Cl.
*G03G 15/02* (2006.01)
*G03G 15/16* (2006.01)
*G03G 21/00* (2006.01)

(52) U.S. Cl. ..... 399/100; 399/101; 399/357

(58) Field of Classification Search ..... 399/100, 399/101, 176, 353, 357; 15/256.51, 256.52
See application file for complete search history.

(56) References Cited

U.S. PATENT DOCUMENTS

| | | | | |
|---|---|---|---|---|
| 7,068,960 | B2 * | 6/2006 | Mizusawa | 399/100 |
| 7,529,498 | B2 * | 5/2009 | Kitagawa et al. | 399/100 |
| 7,574,157 | B2 * | 8/2009 | Ishikawa | 399/100 |

FOREIGN PATENT DOCUMENTS

| | | |
|---|---|---|
| JP | 4-270369 | 9/1992 |
| JP | 5-297690 | 11/1993 |
| JP | 8-62948 | 3/1996 |
| JP | 8-185052 | 7/1996 |
| JP | 10-3202 | 1/1998 |
| JP | 2003-271033 | 9/2003 |
| KR | 1992-004926 | 3/1992 |
| KR | 10-2004-0046652 | 6/2004 |

* cited by examiner

*Primary Examiner*—William J Royer
(74) *Attorney, Agent, or Firm*—Morgan, Lewis & Bockius LLP

(57) ABSTRACT

A cleaning device has: a cleaning member contacting a body-to-be-cleaned at a predetermined nip width, and cleaning a surface of the body-to-be-cleaned; and a supporting member supporting a peripheral surface of the cleaning member. The cleaning member is supported with predetermined degrees of freedom by the supporting member and a surface of the body-to-be-cleaned.

9 Claims, 10 Drawing Sheets

CLEANING DEVICE, PROCESS CARTRIDGE, AND IMAGE FORMING DEVICE

CROSS-REFERENCE TO RELATED APPLICATION

This application is based on and claims priority under 35 USC 119 from Japanese Patent Application No. 2006-232517 filed on Aug. 29, 2006.

BACKGROUND

Technical Field

The present invention relates to a cleaning device, a process cartridge, and an image forming device.

SUMMARY

A first aspect relating to the present invention is a cleaning device including: a cleaning member that contacts a body-to-be-cleaned at a predetermined nip width, and cleans a surface of the body-to-be-cleaned; and a supporting member that supports a peripheral surface of the cleaning member, the supporting member and a surface of the body-to-be-cleaned supporting the cleaning member with predetermined degrees of freedom.

BRIEF DESCRIPTION OF THE DRAWINGS

Exemplary embodiments of the present invention will be described in detail based on the following figures, wherein.

DETAILED DESCRIPTION

Figure 1:
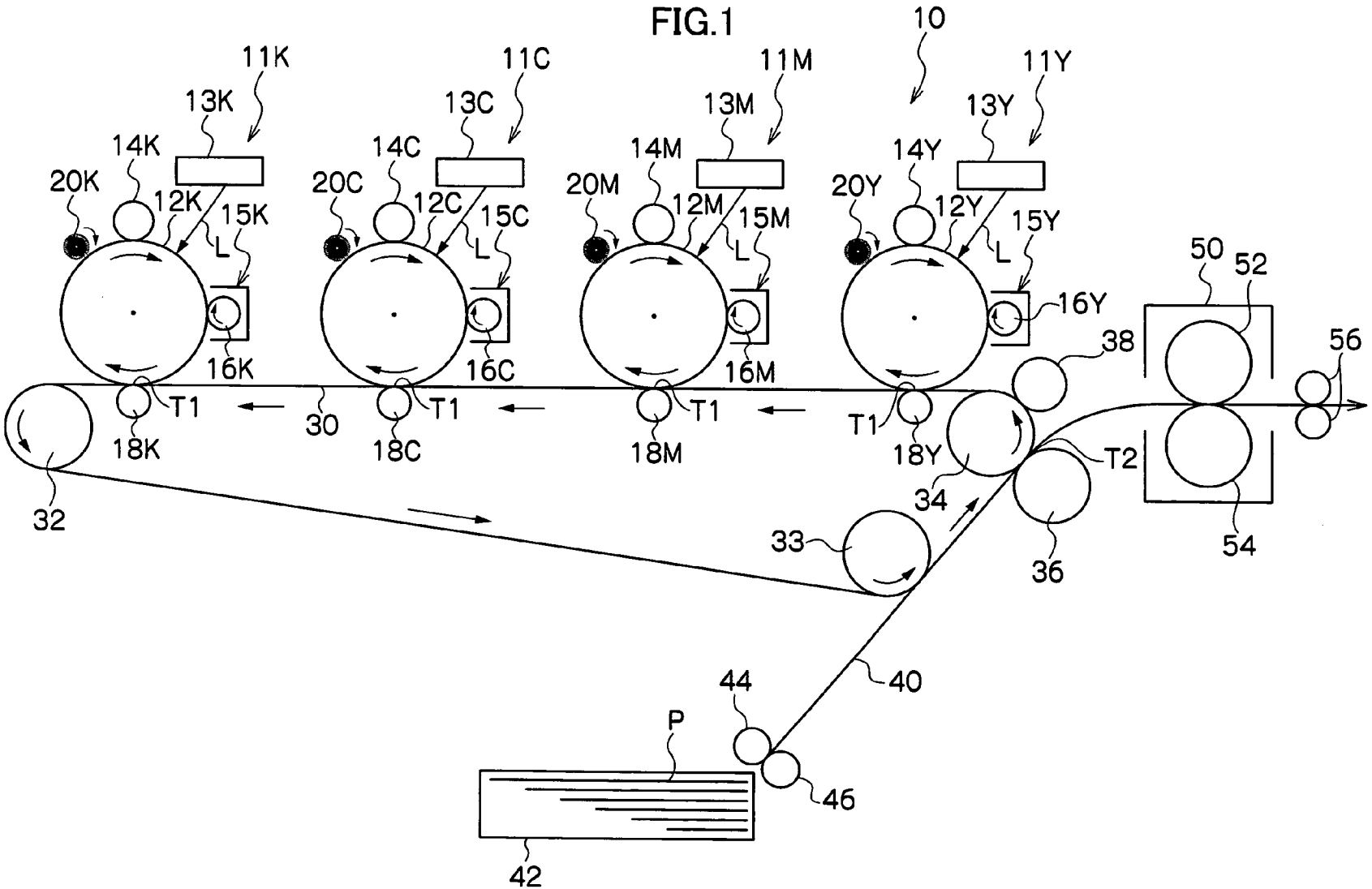
FIG. 1 is a schematic structural diagram showing the overall structure of an image forming device relating to the present exemplary embodiments.

Exemplary embodiments of the present invention will be described in detail hereinafter on the basis of the examples illustrated in the drawings. FIG. 1 is a schematic structural diagram showing the overall structure of an image forming device relating to the present exemplary embodiments. As shown in FIG. 1, an image forming device 10 is a quadruple-tandem-type color copier. Image forming units 11 (11Y, 11M, 11C, 11K), which form toner images of the respective colors of yellow (Y), magenta (M), cyan (C), and black (K), are lined-up along the moving direction of an intermediate transfer belt 30.

Photoreceptor drums 12 (12Y, 12M, 12C, 12K), which serve as image holding bodies which hold images, are provided at the image forming units 11. For example, conductive, cylindrical-tube-shaped bodies, whose surfaces (peripheral surfaces) are covered by photoconductive layers formed from organic photoconductors or the like, are used as the photoreceptor drums 12. The photoreceptor drums 12 are driven by unillustrated motors to rotate at a predetermined processing speed in the directions of the arrows (i.e., so as to rotate rightward) in FIG. 1.

Charging devices having charging rollers (contact chargers) 14 (14Y, 14M, 14C, 14K), which charge the surfaces (peripheral surfaces) of the photoreceptor drums 12, are disposed substantially directly above the photoreceptor drums 12. Exposure devices 13 (13Y, 13M, 13C, 13K), which irradiate laser lights L onto the surfaces (peripheral surfaces) of the photoreceptor drums 12 charged by the charging devices and form electrostatic latent images, are disposed above and obliquely to the right of the photoreceptor drums 12 in FIG. 1.

Developing devices 15 (15Y, 15M, 15C, 15K) are disposed adjacent to the photoreceptor drums 12 at the right sides thereof Developing rollers 16 (16Y, 16M, 16C, 16K), which develop the electrostatic latent images formed on the photoreceptor drums 12 into toner images of the respective colors of yellow (Y), magenta (M), cyan (C), and black (K), are provided at the developing devices 15.

The intermediate transfer belt 30, which is endless and on which are transferred the toner images made visible by the developing devices 15, is disposed beneath the photoreceptor drums 12. Further, beneath the photoreceptor drums 12, primary transfer rollers 18 (18Y, 18M, 18C, 18K) are disposed so as to oppose the photoreceptor drums 12, with the intermediate transfer belt 30 nipped therebetween. The respective contacting portions of the photoreceptor drums 12 and the intermediate transfer belt 30 are primary transfer portions T1. A primary transfer bias which is positive is applied to the primary transfer rollers 18.

Cleaning portions serving as photoconductive body cleaners, which remove the transfer residual toner remaining on the photoreceptor drums 12 after the primary transfer, are disposed adjacent to the photoreceptor drums 12 at the left sides thereof. Brush rollers 20 (20Y, 20M, 20C, 20K) are provided at the cleaning portions. The brush rollers 20 press-contact the surfaces (peripheral surfaces) of the photoreceptor drums 12, are driven to rotate in the direction opposite the direction of rotation of the photoreceptor drums 12, and rub the transfer residual toner off of the photoreceptor drums 12.

The photoreceptor drum 12, the charging roller 14, the developing device 15, the brush roller 20, and a cleaning device 60 which will be described later can be removed from the image forming device 10 (the image forming unit 11), and a process cartridge 22 is structured thereby. Namely, the image forming unit 11, except for the exposure device 13, is the removable process cartridge 22 (refer to FIG. 2 and other drawings).

On the other hand, the intermediate transfer belt 30 is trained around a driving roller 32, a stretching roller 33, and a secondary transfer back-up roller 34, and rotates (moves) in the same direction synchronously with the rotation of the photoreceptor drums 12. Further, the image forming units 11Y, 11M, 11C, 11K are lined-up in series in that order with respect to the direction of movement of the intermediate transfer belt 30.

In this way, the toner images on the photoreceptor drums 12 are primarily-transferred onto the intermediate transfer belt 30 at the respective primary transfer portions T1 by the primary transfer rollers 18 so as to be superposed one on another in the order of yellow (Y), magenta (M), cyan (C), black (K). This primarily-transferred toner image is conveyed toward a secondary transfer portion T2 (a secondary transfer roller 36).

The secondary transfer roller 36 is disposed opposingly at the right side of the intermediate transfer belt 30, such that a sheet conveying path 40 is nipped therebetween. The contacting portion of the secondary transfer roller 36 and the intermediate transfer belt 30 is the secondary transfer portion T2. A secondary transfer bias which is negative is applied to the secondary transfer roller 36. In this way, the secondary transfer roller 36 is assisted by the secondary transfer back-up roller 34, which is for rotating and supporting the intermediate transfer belt 30 from the back portion thereof at the secondary transfer portion T2, and secondarily-transfers, onto a sheet P and at the secondary transfer portion T2, the toner image which was primarily-transferred on the intermediate transfer belt 30.

An intermediate transfer belt cleaner 38, which removes the transfer residual toner remaining on the intermediate transfer belt 30 after the secondary transfer, is provided above and to the right of the secondary transfer back-up roller 34. Further, a sheet feed section 42, in which the sheets P are accommodated, is disposed beneath the intermediate transfer belt 30. A feed roller 44, which feeds the sheets P out from the sheet feed section 42 to the sheet conveying path 40, and a retard roller 46, which separates one-by-one the sheets P which are fed-out, are provided at the right side of the sheet feed section 42.

A fixing device 50, which has a heat roller 52 and a pressure roller 54 which oppose one another, is disposed at the sheet conveying path 40 at the downstream side of the secondary transfer portion T2. A pair of discharging rollers 56 is provided at the downstream side of the fixing device 50. The sheet conveying path 40 extends from the feed roller 44 and the retard roller 46, through the secondary transfer portion T2 and the fixing device 50, to the discharging rollers 56.

Figure 2:
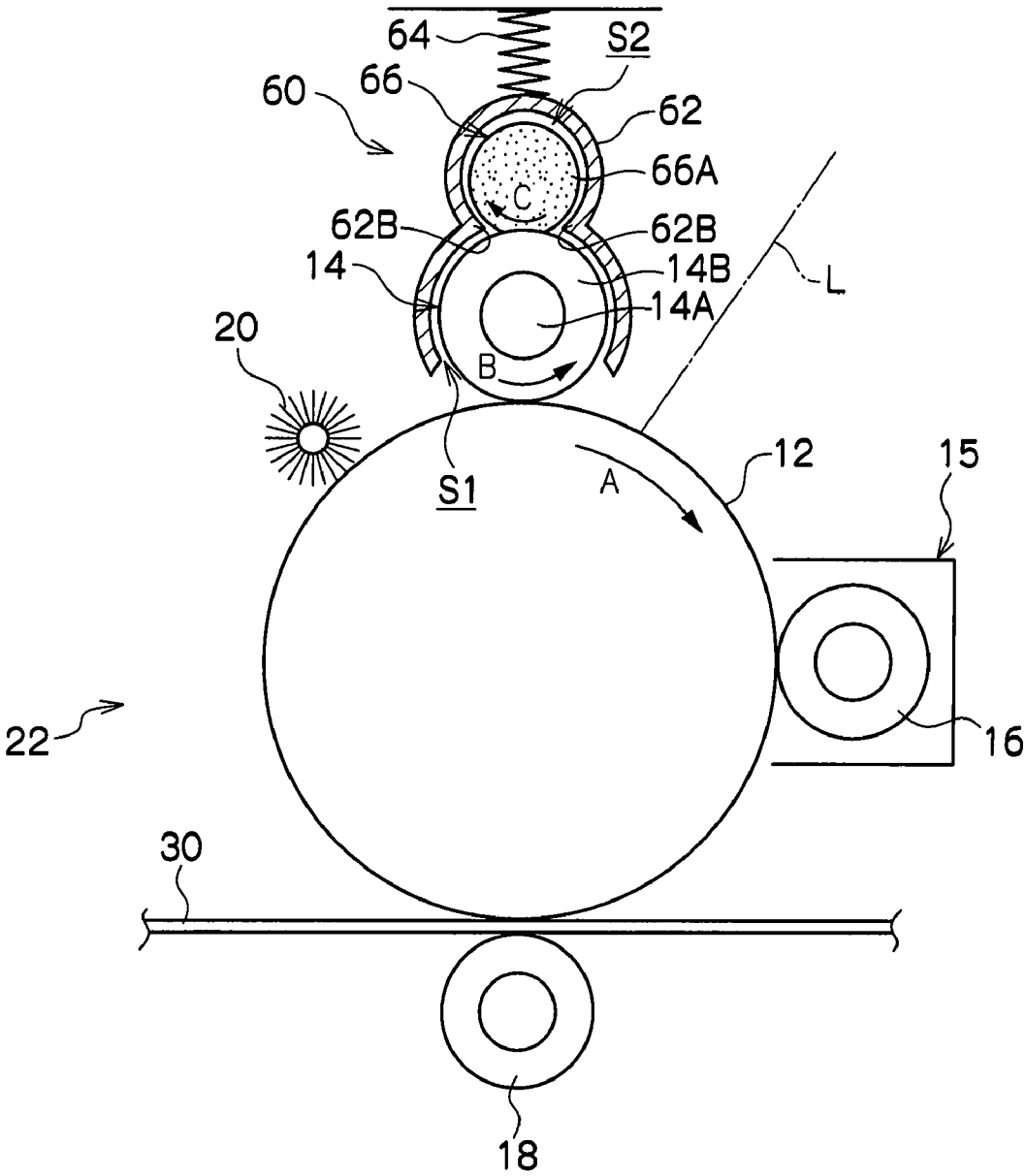
FIG. 2 is a schematic side sectional view showing a cleaning device relating to a first exemplary embodiment.
Figure 3:
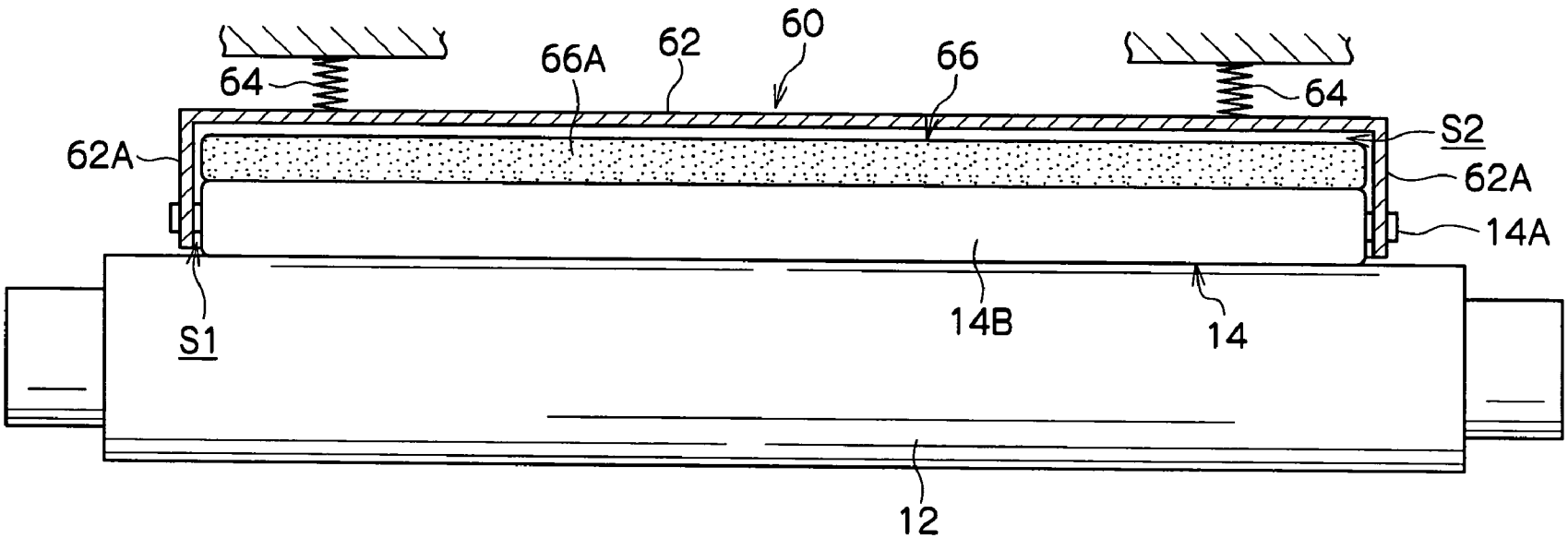
FIG. 3 is a schematic front sectional view showing the cleaning device relating to the first exemplary embodiment.

The charging roller 14, which is a body-to-be-cleaned, and the cleaning device 60, which cleans the charging roller 14, in the image forming device 10 which is structured as described above will be described in detail next. FIG. 2 is a schematic side sectional view showing the cleaning device 60 relating to a first exemplary embodiment, and FIG. 3 is a schematic front sectional view showing the cleaning device 60 relating to the first exemplary embodiment. Note that the photoreceptor drum 12 and the intermediate transfer belt 30 can also be given as examples of the body-to-be-cleaned, and the present invention is applicable to them as well.

As shown in FIG. 2 and FIG. 3, the cleaning device 60 of the first exemplary embodiment has a casing 62 which houses the charging roller 14 and a cleaning roller 66 which serves as a cleaning member and cleans the surface (peripheral surface) of the charging roller 14. The casing 62 serves as a supporting member which disposes the charging roller 14 substantially directly above and in contact with the photoreceptor drum 12, and disposes the cleaning roller 66 substantially directly above and in contact with the charging roller 14. In side sectional view, the casing 62 is substantially shaped as a "snowman" whose lower portion side is open, and, in front sectional view, the casing 62 is formed in a substantially upside-down "U" shape. The casing 62 supports the peripheral surface of the cleaning roller 66 at a longitudinal direction range in which the cleaning roller 66 and the charging roller 14 contact one another.

Ones of ends of coil springs 64 serving as urging members are attached to the top surface of the casing 62. The other ends of the coil springs 64 are attached to predetermined regions within the image forming device 10. In this way, the casing 62 is structured so as to be always urged toward the photoreceptor drum 12. Note that a plurality of the coil springs 64 are provided so as to be spaced apart at predetermined intervals (the illustrated structure has two of the coil springs 64). Further, a structure is possible which does not have the coil springs 64 and in which the casing 62 is connected to a supporting portion (not shown) of the charging roller 14 or the like.

A dc voltage, or a voltage in which ac voltage is superimposed on dc voltage, is applied to the charging roller 14, and the charging roller 14 uniformly charges the surface (peripheral surface) of the photoreceptor drum 12. The charging roller 14 is structured by a charging layer 14B being formed on the periphery of a conductive shaft 14A. The shaft 14A is rotatably supported at side walls 62A (the lower portion sides which structure a first space portion S1) of the casing 62. A predetermined gap is formed between the surface (peripheral surface) of the charging roller 14 and the inner wall surfaces of the casing 62 which structure the first space portion S1.

In this way, the charging roller 14 is structured so as to be rotatably accommodated within the first space portion S1 such that the surface (peripheral surface) of the charging roller 14 is enclosed by the casing 62 except for a predetermined portion thereof (the portion contacting the photoreceptor drum 12), and is urged toward the photoreceptor drum 12 by the urging forces of the coil springs 64, and the surface (peripheral surface) of the charging roller 14 press-contacts the surface (peripheral surface) of the photoreceptor drum 12 at a predetermined pressure.

Metals such as iron, copper, brass, stainless, aluminum, nickel, or the like are used as the material of the shaft 14A, and the material and surface treatment method thereof are appropriately selected in accordance with the application, such as slidability or the like. Further, in the case of a material which is not conductive, the material may be subjected to a treatment for making it conductive by a general processing method, such as plating or the like. For example, resin molded products in which conductive particles or the like are dispersed, or ceramics, or the like may be used. Further, other than the shape of a roller, the shape of a hollow pipe may be used.

The charging layer 14B of the charging roller 14 is a resistant elastic layer. The resistant elastic layer may be structured so as to be divided into a resistant layer and an elastic layer which supports it, in that order from the outer side. Further, a protective layer may be provided on the outer side of the resistant layer as needed, in order to provide the charging roller 14 with durability and contamination-resistance. The material of the elastic layer is conductive or semiconductive, and generally is a material in which conductive particles or semiconductive particles are dispersed in a resin material or a rubber material.

Synthetic resins, such as polyester resin, acrylic resin, melamine resin, epoxy resin, urethane resin, silicon resin, urea resin, polyamide resin, and the like, or the like are used as the resin material. Ethylene-propylene rubber, polybutadiene, natural rubber, polyisobutylene, chloroprene rubber, silicon rubber, urethane rubber, epichlorohydrin rubber, fluorosilicone rubber, ethylene oxide rubber, and the like, or foamed materials in which these materials are foamed, are used as the rubber material.

Carbon black, metals such as zinc, aluminum, copper, iron, nickel, chromium, titanium and the like, metal oxides such as $ZnO\text{-}Al_2O_3$, $SnO_2$—$Sb_2O_3$, $In_2O_3$—$SnO_2$, ZnO—$TiO_2$, MgO—$Al_2O_3$, FeO—$TiO_2$, $TiO_2$, $SnO_2$, $Sb_2O_3$, $In_2O_3$, ZnO, MgO and the ionic compounds such as quaternary ammonium salts and the like, and the like may be used as the conductive particles or semiconductive particles. A single type of these materials may be used, or two or more types may be mixed-together and used. Further, one type or two or more types of inorganic fillers such as talc, alumina, silica, and the like, or organic fillers such as fine powders of fluorine resin or silicon rubber, or the like, may be mixed-together as needed.

The materials of the resistant layer and the protective layer are materials in which conductive particles or semiconductive particles are dispersed in a binder resin, and the resistance thereof is controlled. The resistivity is $10^3$ Ωcm to $10^{14}$ Ωcm, and preferably $10^5$ Ωcm to $10^{12}$ Ωcm, and more preferably $10^7$ Ωcm to $10^{12}$ Ωcm. The film thickness is 0.01 μm to 1000 μm, and preferably 0.1 μm to 500 μm, and more preferably 0.5 μm to 100 μm.

Acrylic resin, cellulose resin, polyamide resin, methoxymethylated Nylon™, ethoxymethylated Nylon™, polyurethane resin, polycarbonate resin, polyester resin, polyethylene resin, polyvinyl resin, polyarylate resin, polythiophene resin, polyolefin resins such as PFA, FEP, PET and the like, styrene-butadiene resin, melamine resin, epoxy resin, urethane resin, silicon resin, urea resin, or the like is used as the binder resin.

One type or two or more types of carbon black, metals, metal oxides, or ionic compounds such as quaternary ammonium salts or the like which manifest ion conductivity, such as those listed above in relation to the elastic layer, or the like are mixed-together as the conductive particles or the semiconductive particles. Further, one type or two or more types of antioxidants such as hindered phenol, hindered amine or the like, inorganic fillers such as clay, kaolin, talc, silica, alumina or the like, organic fillers such as fine powders of fluorine resin or silicon resin, or the like, lubricants such as silicone oil or the like, and the like may be added as needed. Still further, surfactants, charge controlling agents, and the like are added as needed.

Blade coating, Meyer bar coating, spray coating, immersion coating, bead coating, air knife coating, curtain coating, or the like can be used as the technique (method) for forming these layers.

On the other hand, the cleaning roller 66, which contacts the surface (peripheral surface) of the charging roller 14 due to its own weight and which cleans this surface (peripheral surface), is disposed within a second space portion S2 at the upper portion side of the casing 62, in a state in which there is a predetermined gap between the cleaning roller 66 and the inner wall surface of the casing 62 structuring the second space portion S2. Namely, the cleaning roller 66 is formed by a solid-cylindrical sponge 66A, and is structured such that a shaft or the like is not provided at the axially central portion thereof. The cleaning roller 66 is housed within the second space portion S2 so as to be able to move (including rotate) freely, without being pivotally-supported at the casing 62 (the cleaning roller 66 is supported with predetermined degrees of freedom by the inner wall surface of the casing 62 and the surface of the charging roller 14). Note that projecting portions 62B, which project-out by a predetermined length toward the inner side, are the boundary portions between the first space portion S1 and the second space portion S2.

Here, the photoreceptor drum 12 is driven to rotate in the direction of arrow A in the figures by an unillustrated driving motor, and the charging roller 14 is slave-rotated in the direction of arrow B in the figures by the rotation of the photoreceptor drum 12. Accordingly, the cleaning roller 66 is structured so as to remove contamination (foreign matter) such as transfer residual toner and external additives and the like, which are adhering to the surface (peripheral surface) of the charging roller 14 (i.e., so as to clean the surface of the charging roller 14), while rotating in an accompanying manner (slave-rotating) in the direction of arrow C in the figures due to the rotation of the charging roller 14. Note that a structure may be employed in which a driving source is provided at the charging roller 14, and a velocity difference (difference in linear velocity) provided between the photoreceptor drum 12 and the charging roller 14.

The sponge 66A forming the cleaning roller 66 is a porous elastic body formed from a foam having a porous, three-dimensional structure. Namely, the material of the sponge 66A is selected from foamed resins or rubbers such as polyurethane, polyethylene, polyamide, polypropylene or the like. Polyurethane, which is strong in terms of tear strength, tensile strength, and the like, is particularly preferably used so that the sponge 66A can efficiently clean foreign matter such as the transfer residual toner and external additives and the like by sliding and rubbing against the charging roller 14 while being slave-driven thereby, and at the same time, the surface (peripheral surface) of the charging roller 14 is not scratched due to the rubbing of the sponge 66A, and also so that tearing and breakage do not arise over a long period of time.

Operation of the image forming device 10, which is equipped with the cleaning device 60 of the first exemplary embodiment having the above-described structure, will be described next. When an image formation signal is inputted to the image forming device 10 and the photoreceptor drums 12 are driven to rotate, the charging rollers 14 are slave-rotated in accordance with the rotation of the photoreceptor drums 12, and the surfaces (peripheral surfaces) of the photoreceptor drums 12 are charged uniformly by the charging rollers 14. Then, the laser lights L are illuminated from the exposure devices 13 onto the surfaces (peripheral surfaces) of the photoreceptor drums 12 on the basis of the image formation signal. The surfaces (peripheral surfaces) of the photoreceptor drums 12 are exposed by these laser lights L, and electrostatic latent images are formed.

The electrostatic latent images formed on the photoreceptor drums 12 are developed into toner images of the respective colors of yellow (Y), magenta (M), cyan (C), and black (K) by the developing rollers 16 of the developing devices 15, and are primarily-transferred onto the intermediate transfer belt 30 at the primary transfer portions T1 so as to be superposed one on another. Note that the transfer residual toner which remains on the photoreceptor drums 12 after the primary transfer is rubbed-off and removed by the brush rollers 20.

On the other hand, the sheet P accommodated in the sheet feed section 42 is fed-out by the feed roller 44, and is separated by the retard roller 46 such that only the uppermost sheet P is guided to the sheet conveying path 40. The sheet P is fed-in between the secondary transfer roller 36 and the secondary transfer back-up roller 34, i.e., to the secondary transfer portion T2, at a predetermined timing. At this secondary transfer portion T2, the toner image, which has been primarily-transferred onto the intermediate transfer belt 30, is secondarily-transferred onto the sheet P.

The sheet P on which the toner image has been transferred is conveyed along the sheet conveying path 40 to the downstream side and is guided to the fixing device 50, and the toner image is fixed by the heat and pressure of the heat roller 52 and the pressure roller 54. Then, the sheet P, on which an image has been formed by the fixing of the toner image, is discharged-out to an unillustrated sheet discharge portion by the discharging rollers 56. Further, the transfer residual toner, which remains on the image region of the intermediate transfer belt 30 after the secondary transfer, is rubbed-off and removed by the intermediate transfer belt cleaner 38.

Further, the cleaning rollers 66 are slave-rotated in accordance with the rotation of the charging rollers 14, and the contamination (foreign matter), such as the transfer residual toner and external additives and the like adhering to the surfaces (peripheral surfaces) of the charging rollers 14, is cleaned-off by the cleaning rollers 66 which are press-contacting the charging rollers 14 in the axial direction. A good cleaning performance is thereby maintained and continued. Due to the above-described operations, a full-color image is formed on the sheet P.

Figure 4:
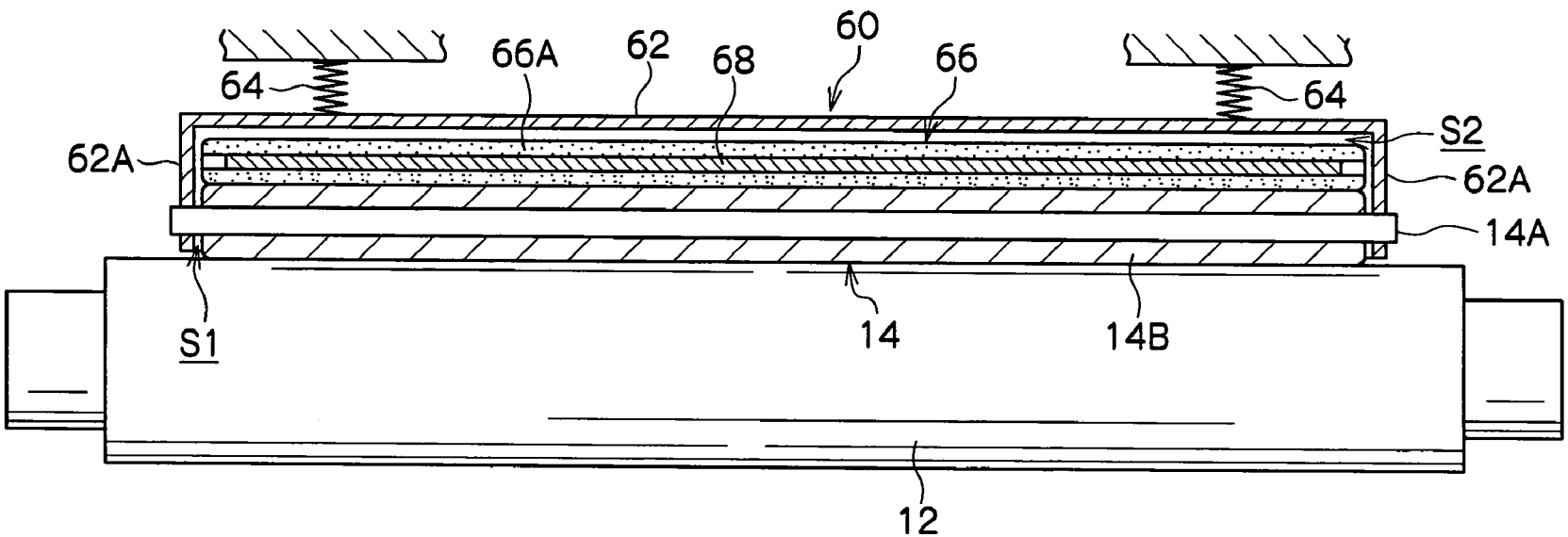
FIG. 4 is a schematic front sectional view showing a cleaning device relating to a second exemplary embodiment.

The cleaning device 60 of a second exemplary embodiment will be described next. Note that structures and operations which are equivalent to those of the cleaning device 60 of the above-described first exemplary embodiment are denoted by the same reference numerals, and detailed description thereof is omitted. As shown in FIG. 4, in the cleaning device 60 of the second exemplary embodiment, a metal shaft 68, which serves as a weighting member and whose specific gravity is higher than that of the cleaning roller 66, is provided at the axially central portion of the cleaning roller 66.

The metal shaft 68 is not for supporting the cleaning roller 66 at the casing 62, and is for making the weight of the cleaning roller 66 heavier and increasing the press-contact force of the cleaning roller 66 with respect to the charging roller 14 (improving the cleaning performance). Accordingly, there is no need for the both end portions of the shaft 68 to project-out from the both end portions of the cleaning roller 66 (there is no need to make the shaft 68 longer than the cleaning roller 66), and, in the illustrated structure, the both end portions of the shaft 68 do not project out. Stainless steel or the like can be used as the specific material of the shaft 68.

The weighting member provided within the cleaning roller 66 is not limited to the illustrated metal shaft 68, and may be any structure provided that it can make the weight of the cleaning roller 66 heavier and increase the press-contact force of the cleaning roller 66 with respect to the charging roller 14, e.g., a plurality of metal shafts (not shown) or the like having the same weights and having diameters smaller than the shaft 68 may be embedded at uniform intervals in the peripheral direction, or the like. In any case, it is preferable that the weighting member which is provided within the cleaning roller 66 be provided such that the rotational center (center of gravity) thereof does not become offset, so that the cleaning roller 66 can rotate accompanying the rotation of the charging roller 14.

Figure 5:
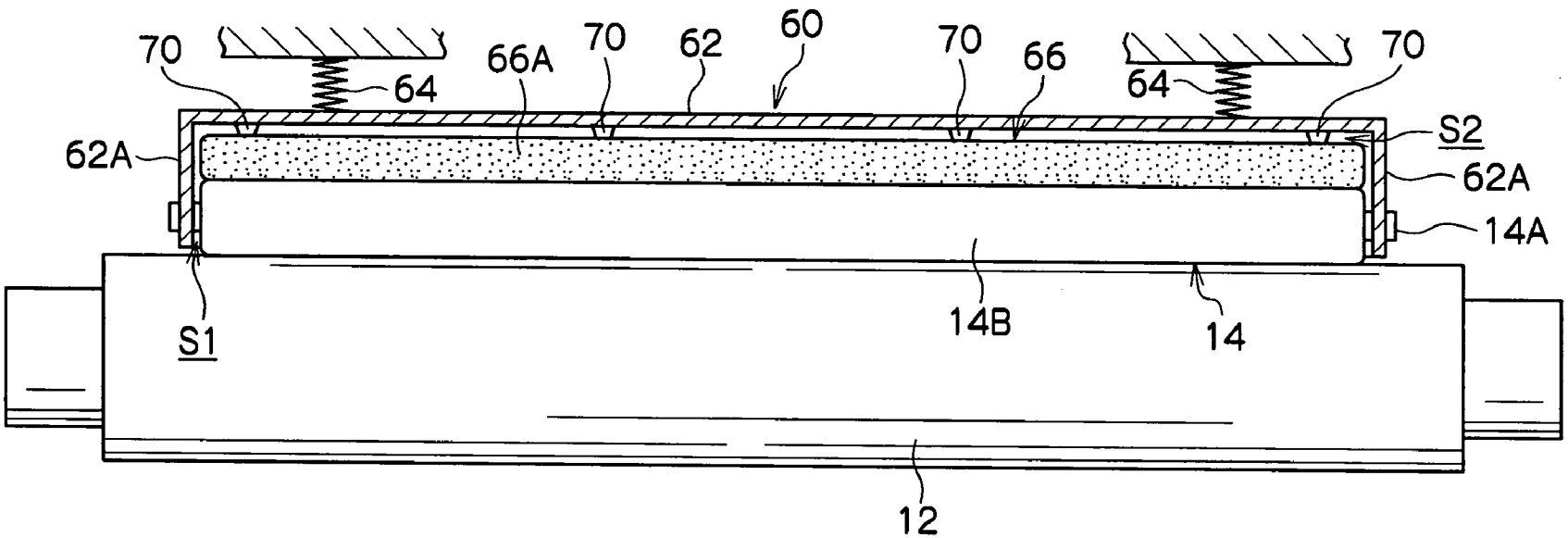
FIG. 5 is a schematic front sectional view showing a cleaning device relating to a third exemplary embodiment.
Figure 6A:
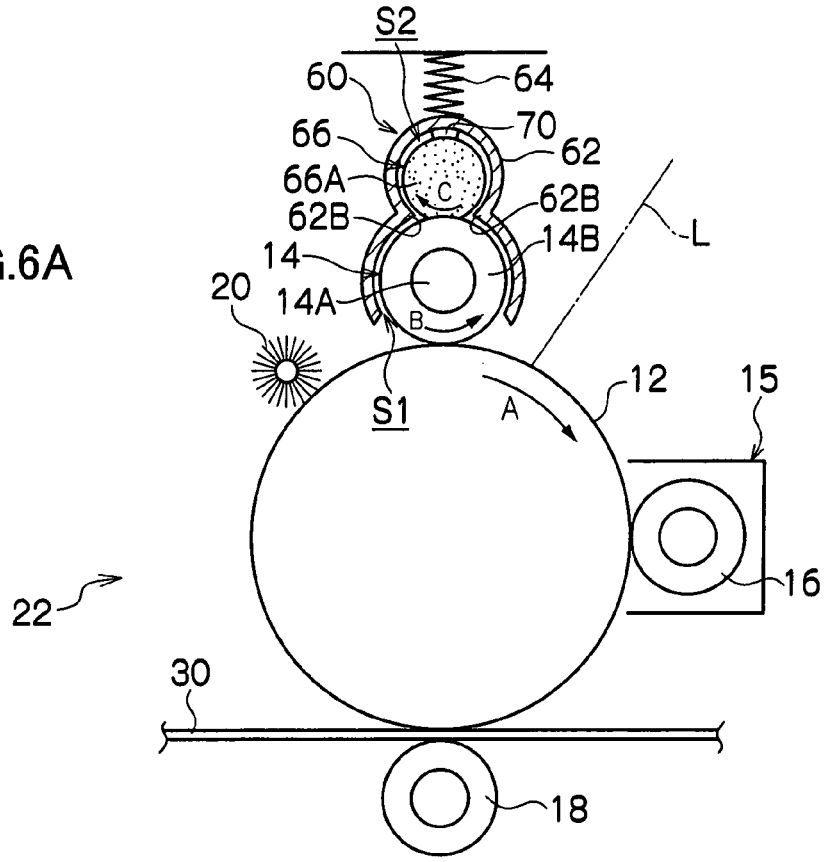
FIGS. 6A and 6B are schematic side sectional views showing the cleaning device relating to the third exemplary embodiment.

The cleaning device 60 of a third exemplary embodiment will be described next. Note that structures and operations which are equivalent to those of the cleaning device 60 of the above-described first exemplary embodiment are denoted by the same reference numerals, and detailed description thereof is omitted. As shown in FIG. 5 and FIG. 6A, in the cleaning device 60 of the third exemplary embodiment, a plurality of projections 70 are provided so as to project from the inner wall ceiling surface of the casing 62 structuring the second space portion S2, so as to be spaced apart from one another at predetermined intervals in the axial direction. The projections 70 serve as position regulating members (structures) for pressing the cleaning roller 66 toward the charging roller 14 (regulating the position of the cleaning roller 66 toward the charging roller 14).

The projections 70 are formed in the shapes of ribs which extend over predetermined lengths in the peripheral direction, and contact only portions of the surface (peripheral surface) of the cleaning roller 66, so that the surface area of contact between the projections 70 and the cleaning roller 66 can be made to be small. Note that it is possible to not provide the plurality of projections 70 at the inner wall ceiling surface of the casing 62, and rather, to make the volume of the second space portion S2 at the casing 62 small and cause the inner wall ceiling surface thereof to contact the surface (peripheral surface) of the cleaning roller 66.

Figure 6B:
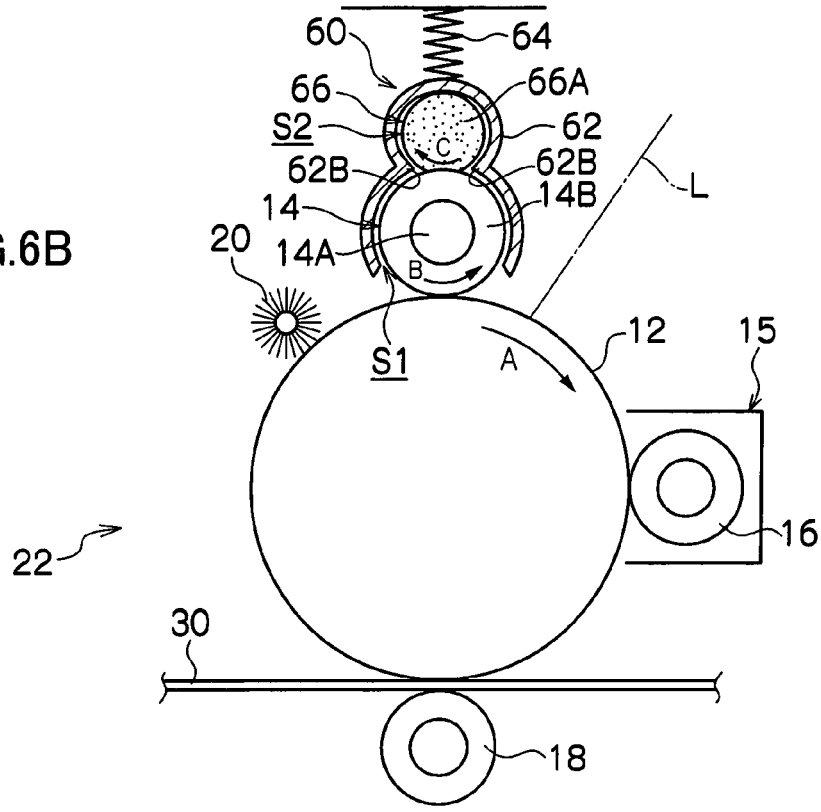

However, in this case, as shown in FIG. 6B, the inner wall ceiling surface of the casing 62 always contacts the surface (peripheral surface) of the cleaning roller 66 along the axial direction, and presses the cleaning roller 66 toward the charging roller 14. Therefore, frictional force arises between the inner wall ceiling surface of the casing 62 and the surface (peripheral surface) of the cleaning roller 66.

Accordingly, in this case, it is preferable to either apply a coating (e.g., a Teflon™ coating) which has good slidability with respect to the cleaning roller 66 at least at the inner wall ceiling surface of the casing 62, or to use, as the material of the casing 62, a material (e.g., polyacetal or the like) having good slidability with respect to the cleaning roller 66 so as to make the frictional force between the cleaning roller 66 and the inner wall ceiling surface of the casing 62 be less than the frictional force between the cleaning roller 66 and the charging roller 14. Note that such structures for decreasing friction may be employed at the surfaces of the projections 70 which contact the cleaning roller 66, or on the projections 70 themselves.

Figure 7:
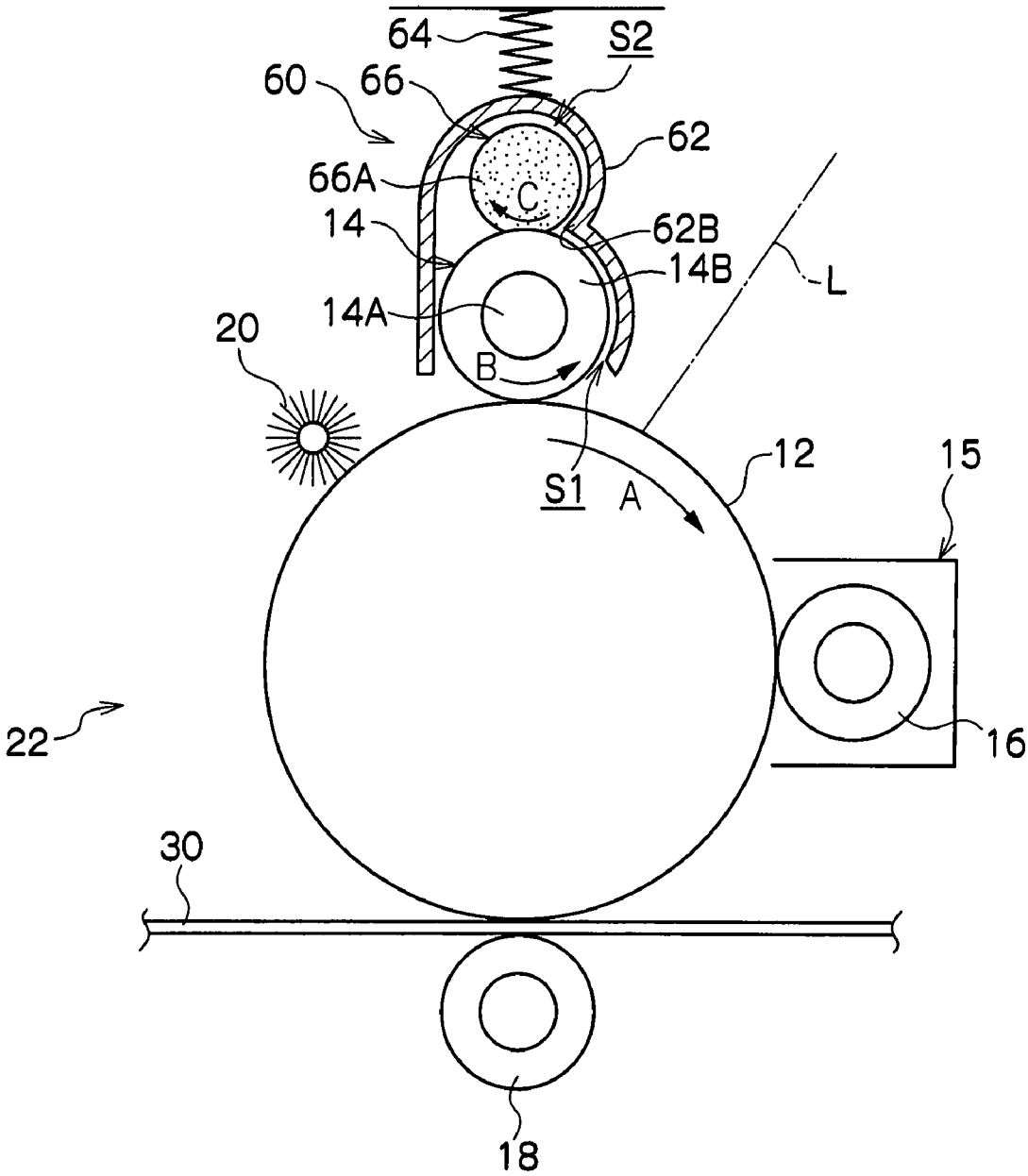
FIG. 7 is a schematic side sectional view showing a cleaning device relating to a fourth exemplary embodiment.

The cleaning device 60 of a fourth exemplary embodiment will be described next. Note that structures and operations which are equivalent to those of the cleaning device 60 of the above-described first exemplary embodiment are denoted by the same reference numerals, and detailed description thereof is omitted. As shown in FIG. 7, in the cleaning device 60 of the fourth exemplary embodiment, the casing 62 is formed substantially in the shape of the Greek letter "β" as seen in side sectional view. Namely, the projecting portion 62B, which is the boundary portion between the first space portion S1 and the second space portion S2, is provided only at one side, and the other side is rectilinear.

Figure 8A:
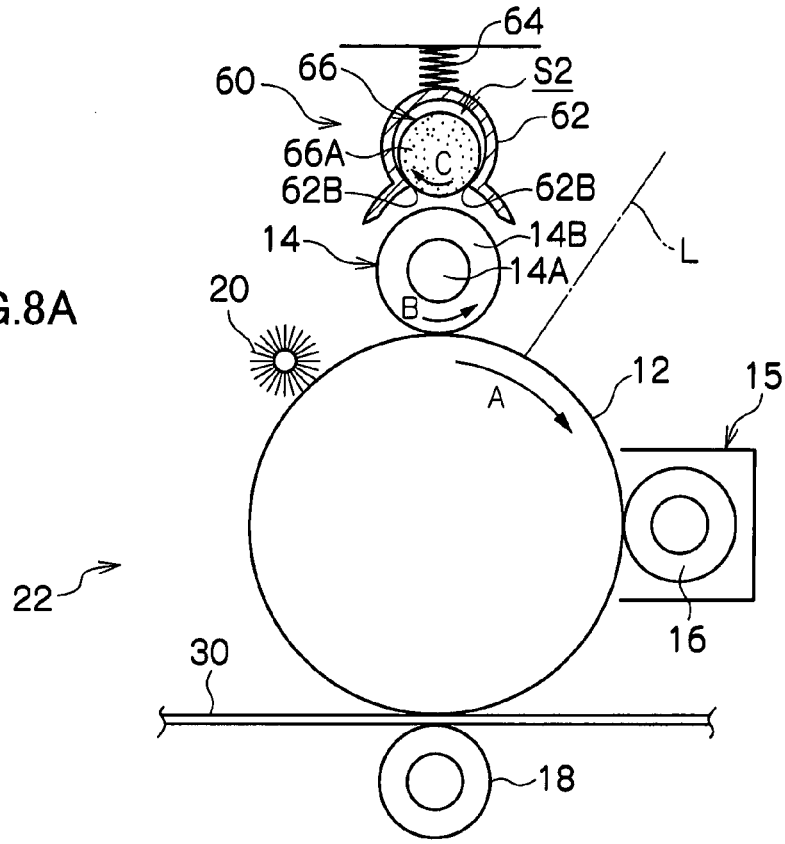
FIGS. 8A and 8B are schematic side sectional views showing a cleaning device relating to a fifth exemplary embodiment.
Figure 8B:
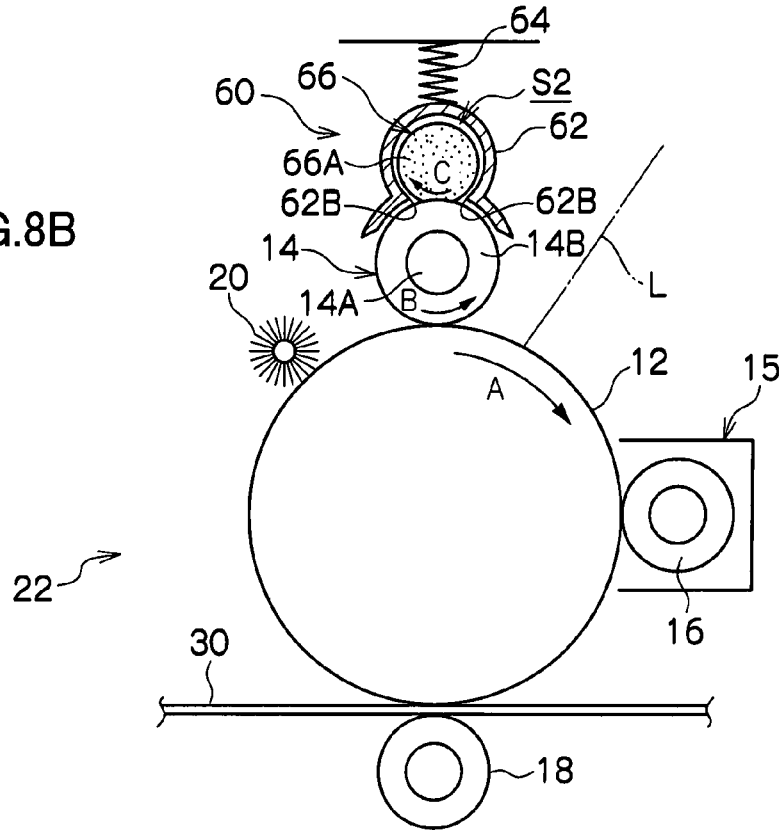

The cleaning device 60 of a fifth exemplary embodiment will be described next. Note that structures and operations which are equivalent to those of the cleaning device 60 of the above-described first exemplary embodiment are denoted by the same reference numerals, and detailed description thereof is omitted. As shown in FIGS. 8A and 8B, in the cleaning device 60 of the fifth exemplary embodiment, the casing 62 which houses the cleaning roller 66 is structured so as to be able to contact and separate from the charging roller 14. Namely, a raising/lowering mechanism (not shown), which raises and lowers the casing 62, is provided at the image forming device 10 equipped with the cleaning device 60 of the present fifth exemplary embodiment.

Here, the lower portion side of the casing 62 is opened wider than in the above-described first exemplary embodiment, and the casing 62 is structured so as to, at longest, cover only the top half of the charging roller 14. The cleaning roller 66 is held by the projecting portions 62B so as to not drop-down out from the second space portion S2 of the casing 62. Accordingly, when the casing 62 is raised and lowered by the raising/lowering mechanism, the cleaning roller 66 can be set at a position of contacting the charging roller 14 and a position of being apart from the charging roller 14.

Figure 9:
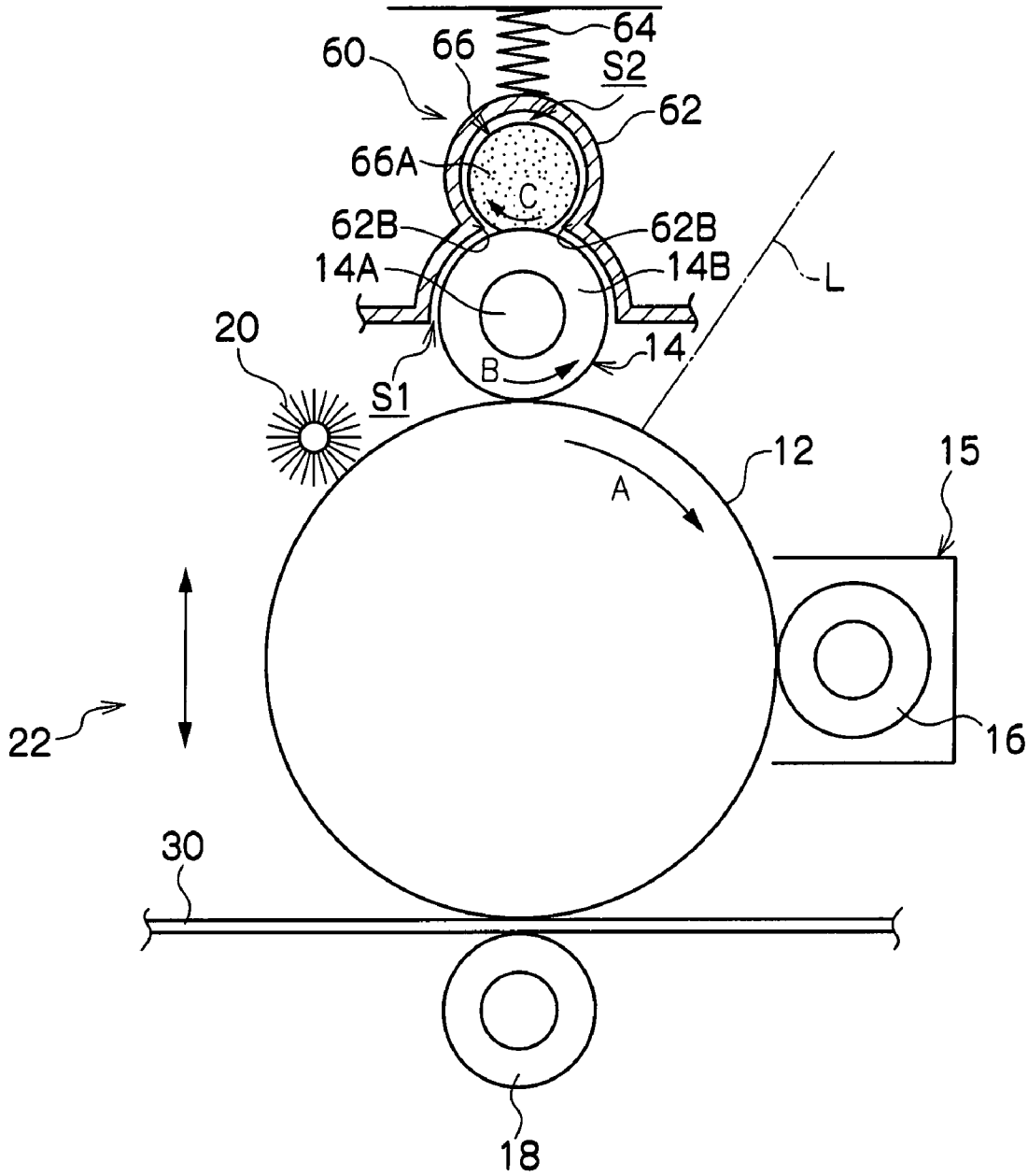
FIG. 9 is a schematic side sectional view showing the cleaning device relating to the fifth exemplary embodiment.

Note that an arbitrary structure such as a rack-and-pinion, a ball screw, a cylinder, or the like, can be employed as the raising/lowering mechanism. Or, the casing 62 may be structured so as to be able to be raised and lowered manually, without providing a raising/lowering mechanism. In this case, it is preferable to provide a mechanism which is such that the casing 62 is held at the raised position, and it is preferable to set the casing 62 in this state at times such as when the image forming device 10 is shipped-out or the like. Further, as shown in FIG. 9, the casing 62 which houses (holds) the cleaning roller 66 may be structured so as to be fixed to the image forming device main body, and the image forming unit 11 which includes the charging roller 14 structured so as to be able to be raised and lowered.

Figure 10:
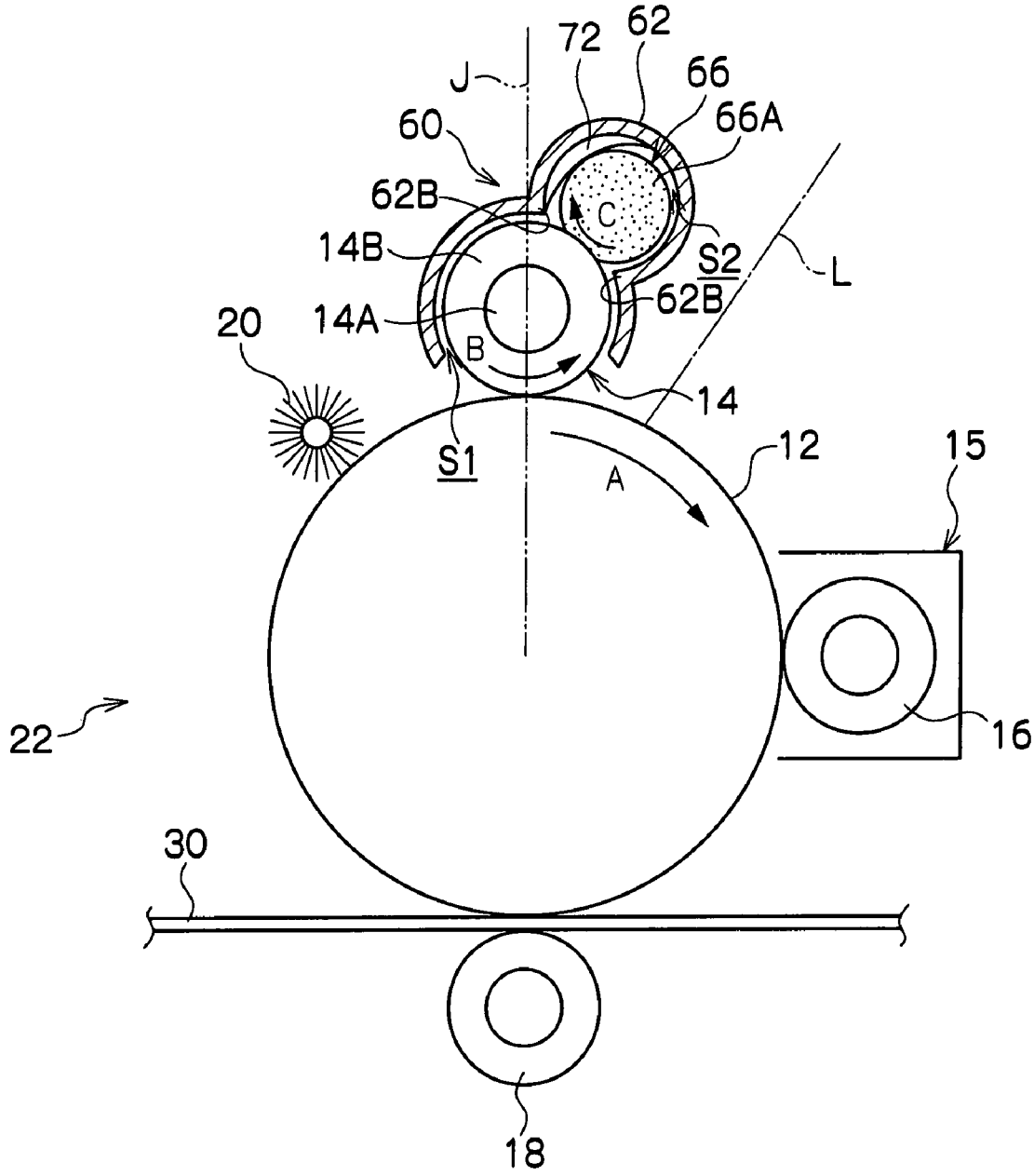
FIG. 10 is a schematic side sectional view showing a cleaning device relating to a sixth exemplary embodiment.

Finally, the cleaning device 60 of a sixth exemplary embodiment will be described. Note that structures and operations which are equivalent to those of the cleaning device 60 of the above-described first exemplary embodiment are denoted by the same reference numerals, and detailed description thereof is omitted. As shown in FIG. 10, in the cleaning device 60 of the sixth exemplary embodiment, the cleaning roller 66 is not disposed substantially directly above the charging roller 14, and is disposed so as to be offset toward the rotating direction downstream side of the photoreceptor drum 12 (i.e., toward the developing device 15 side), further than an imaginary line J which connects the center of the photoreceptor drum 12 and the center of the charging roller 14.

In this case, the cleaning roller 66 is disposed toward the downstream side in the direction of rotation of the charging roller 14. Therefore, a plurality of projections 72 are provided so as to project from the inner wall ceiling surface structuring the second space portion S2 of the casing 62 which accommodates the cleaning roller 66, so as to be spaced apart from one another at predetermined intervals in the axial direction. The projections 72 serve as position regulating members for regulating the position of the cleaning roller 66 toward the charging roller 14 side.

The projections 72 are formed in the shapes of ribs which extend over predetermined lengths in the peripheral direction, so that the surface area of contact between the projections 72 and the cleaning roller 66 is made to be small. When the cleaning roller 66 is disposed toward the downstream side in the rotating direction of the charging roller 14, the projections 72 contact only portions of the surface (peripheral surface) of the cleaning roller 66, and regulate the position of the cleaning roller 66 toward the charging roller 14 side.

Note that it is possible to not provide the plurality of projections 72 at the inner wall ceiling surface of the casing 62, and rather, to make the volume of the second space portion S2 at the casing 62 small. Here, in the same way as in the above-described third exemplary embodiment, a structure for reducing the frictional force which reduces the frictional force with respect to the cleaning roller 66 may be employed at the inner wall surface of the casing 62 which structures the second space portion S2 and which the cleaning roller 66 contacts, or at the surfaces of the projections 72 which surfaces contact the cleaning roller 66. Further, the position regulating members are, of course, not limited to those illustrated in FIG. 5, FIG. 6A, and FIG. 10.

Examples of the relationships between the structures and the effects in the above-described exemplary embodiments of the present invention are given here.

(1) When the metal shaft 68 is provided within (at the axially central portion of) the cleaning roller 66, the metal shaft 68 is a metal at the periphery of the charging roller 14 to which high-voltage is applied. Accordingly, as shown in FIG. 4, the metal shaft 68 is made to be shorter than the cleaning roller 66 by a predetermined length, and is made to not protrude out from the cleaning roller 66. In this way, the occurrence of leaking is suppressed.

(2) When the projections 70 are provided at the inner wall ceiling surface which structures the second space portion S2 of the casing 62, the space for placement of the cleaning roller 66 within the second space portion S2 is narrowed, and therefore, free movement of the cleaning roller 66 within the casing 62 (other than rotation) is suppressed. In this way, the press-contact force of the surface (peripheral surface) of the cleaning roller 66 with respect to the surface (peripheral surface) of the charging roller 14 can be raised (increased).

(3) At the casing 62, when the projecting portion 62B, which is the boundary portion between the first space portion S1 and the second space portion S2, is provided only at one side and the other side is rectilinear, it is easy for the cleaning roller 66 to be placed-in and taken-out from the casing 62, and replacement of the cleaning roller 66 is easy.

(4) When the casing 62 which houses (holds) the cleaning roller 66 is structured so as to be able to contact and separate from the charging roller 14, the cleaning roller 66 can be withdrawn (set apart) from the charging roller 14 at times other than the time of the cleaning operation. Accordingly, deformation, non-uniform rotation, poor cleaning, and the like of the cleaning roller 66, which arise due to the cleaning roller 66 always being in a state of contact with the charging roller 14, can be prevented.

(5) When the cleaning roller 66 is not disposed directly above the charging roller 14 and is disposed so as to be offset, for example, toward the developing device 15, and the projections 72 are provided at the inner wall ceiling surface which structures the second space portion S2 of the casing 62, the space for placement of the cleaning roller 66 within the second space portion S2 is narrowed. Therefore, free movement of the cleaning roller 66 within the casing 62 (except for rotation) is suppressed. In this way, the press-contact force of the surface (peripheral surface) of the cleaning roller 66 with respect to the surface (peripheral surface) of the charging roller 14 can be raised (increased).

(6) Because the cleaning roller 66 can be removed from the image forming unit 11 which serves as the process cartridge 22, the cost of the image forming unit 11 can be reduced. Because the image forming unit 11 is replaced as an expendable article at an interval which is shorter than the lifespan of the image forming device 10, this is effective in lowering the cost of the image forming unit 11.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a cleaning member that has a peripheral surface that contacts a surface of a body-to-be-cleaned, and cleans the surface of the body-to-be-cleaned; and a supporting member that has a wall surface facing the peripheral surface of the cleaning member, with a predetermined gap being provided between the wall surface thereof and the peripheral surface of the cleaning member, the peripheral surface of the cleaning member being supported by the wall surface of the supporting member and the surface of the body-to-be-cleaned with a predetermined degree of freedom, and the cleaning member contacting the surface of the body-to-be-cleaned due to its own weight.

2. The cleaning device of claim 1, wherein the wall surface of the supporting member supports the peripheral surface of the cleaning member with a predetermined degree of freedom in a longitudinal direction range over which the peripheral surface of the cleaning member and the surface of the body-to-be-cleaned contact one another.

3. The cleaning device of claim 1, wherein a member, having a higher specific gravity than the specific gravity of the cleaning member is provided at an interior of the cleaning member.

4. The cleaning device of claim 1, wherein the wall surface of the supporting member has a position regulating member that regulates a position of the cleaning member toward the body-to-be-cleaned.

5. The cleaning device of claim 4, wherein the position regulating member is provided with a structure that reduces frictional force.

6. The cleaning device of claim 1, wherein the supporting member is configured to enclose the body-to-be-cleaned.

7. The cleaning device of claim 1, wherein the body-to-be-cleaned is a charging roller that charges an image holding member which holds an image.

8. A process cartridge comprising the cleaning device of claim 7.

9. An image forming device comprising:

an image holding member that holds an image;

a charging roller that charges the image holding member; and the cleaning device of claim 1.

* * * * *